US005673975A

United States Patent [19]

Boucherie

[11] Patent Number: 5,673,975

[45] Date of Patent: Oct. 7, 1997

[54] BRUSH MANUFACTURING MACHINE AND METHOD FOR MANUFACTURING BRUSHES

[75] Inventor: Leonel Polydore Boucherie, Izegem, Belgium

[73] Assignee: Firma G.B. Boucherie, Naamloze Vennootschap, Belgium

[21] Appl. No.: 590,821

[22] Filed: Jan. 24, 1996

[30] Foreign Application Priority Data

Jan. 24, 1995 [BE] Belgium ..... 09500058

[51] Int. Cl.[6] ..... A46D 3/08

[52] U.S. Cl. ..... 300/8; 300/11

[58] Field of Search ..... 300/2–11, 21

[56] References Cited

U.S. PATENT DOCUMENTS 5,533,792 7/1996 Boucherie ..... 300/11

FOREIGN PATENT DOCUMENTS 0 433 470 6/1991 European Pat. Off. .

*Primary Examiner*—Mark Rosenbaum
*Attorney, Agent, or Firm*—Bacon & Thomas

[57] ABSTRACT

The brush manufacturing machine of the type wherein at least one rotary brush body carrying drum located at a machine workstation is cyclically supplied with empty brush bodies by a brush body feeding device and is cyclically rotated to cause each such brush body to be eventually presented in proper position before a filling tool for filling of the brush body with brush fibers, wherein the machine includes at least two drums located at sequential workstations, at least one filling tool at each workstation cooperating with each respective drum for delivering brush fibers to the brush bodies carried by the drums, at least one manipulator operable so as to periodically engage and transfer brush bodies from at least one drum to another drum following the one drum, and a transport device for carrying filled brush bodies away from a drum of the machine. The invention also resides in a method of making brush bodies including the steps of locating a series of brush body carrying drums having working side areas arranged to support and hold brush bodies at sequential workstations and periodically supplying the side areas of the first drum of the series with unfilled brush bodies by a brush body supply device located in advance of the first drum; locating a filling tool at each workstation, the filling tool being arranged to insert brush fibers into at least some of the brush bodies carried by a respective drum at the workstation; transferring the brush bodies between the drums of the series, including transferring unfilled brush bodies to at least one of the drums of the series directly from another one of the drums of the series located at a workstation preceding the drum to which the unfilled brush bodies are transferred. Several embodiments of the invention are described.

16 Claims, 4 Drawing Sheets

1
2
3
4
5
6
7
8
9
10
11
12
13
14
15
16
22
23
A
D
E
X
Y
R 9
10
1
33
34
38
32
13
29
A
R
41
12
36
35
39
30
42
16
37
31
40

10
9
1
10
10
46
45
43
46
49
45
45
10
45
46
A
R
13
10
46
10
D
51
E
48
47
47
44
50
10
48
10
12
10
A
R
13
10
47
48
10
13
13
48
47
10
10
23
16

BRUSH MANUFACTURING MACHINE AND METHOD FOR MANUFACTURING BRUSHES

FIELD OF THE INVENTION

The present invention concerns a brush manufacturing machine, as well as a method for manufacturing brushes.

BACKGROUND INFORMATION

It is known that brush manufacturing machines can be equipped with a preferably multi-sided rotatable drum, which is provided on its working side areas with brush body holders, such that the working side areas of the drum can be successively presented to various work stations. As a result, it is possible to place empty brush bodies in the brush body holders in a first work station, to provide brush fibers in the brush bodies in a second work station and to take away the filled brushes from the drum in a third work station.

In order to accelerate the production capacity, with a minimum of additional parts, it was suggested in EP 433.470 to use two filling tools placed on top of one another and to make them cooperate with two brush bodies provided on one working side area of the drum. Although a higher production capacity is indeed made possible in this manner, there is a disadvantage in that the filling tools and the accompanying fibre cartridges, in particular the fibre cartridge of the bottommost filling tool, are not easily accessible, or in that the drum sizes become too large which, due to the greater mass, has a negative influence on the production speed of the machine.

The invention has an objective a brush manufacturing machine which is particularly efficient and with which the above-mentioned disadvantage can be excluded.

SUMMARY OF THE INVENTION

To this end, the invention has an objective a brush manufacturing machine of the type whereby unfilled brush bodies are provided on a preferably multi-sided drum located at successive workstations, so as to present them to a filling tool, and including at least two drums located successive filing workstations each cooperating with at least one accompanying filling tool; supply means which directly feed the brush bodies to be filled to and at least one of the above-mentioned drums; at least one manipulator provided between the drums which makes it possible to carry unfilled brush bodies from one drum to another one;.

Due to the fact that several drums are used, and due to the fact that one or more manipulators are used with which brush bodies can be moved from one drum to another drum, the efficiency of the machine is significantly improved.

Preferably, only one filling tool per drum will be provided. This enables that the filling tools and consequently the filling cartridges to be situated further away from one another.

The invention also has as an objective a method for manufacturing brushes of the type whereby brush bodies are provided on a drum so as to present the bodies to a filling tool, wherein a number of the brush bodies are indirectly supplied to the drum upon which they are filled, whereby this indirect supply is carried out via at least one other drum. During each machine cycle at least two brush bodies are preferably placed on the working side area of a drum; in that at least one of these brush bodies are filled with brush fibres on the same drum; and in that at least one of the other brush bodies is removed to a following drum by means of a manipulator, whereby it too is filled with brush fibres on this drum or a following drum.

DESCRIPTION OF THE DRAWINGS

In order to better explain the characteristics of the invention, the following preferred embodiments are given as an example only without being limitative in any way, with reference to the accompanying drawings, where.

DETAILED DESCRIPTION

Figure 1:
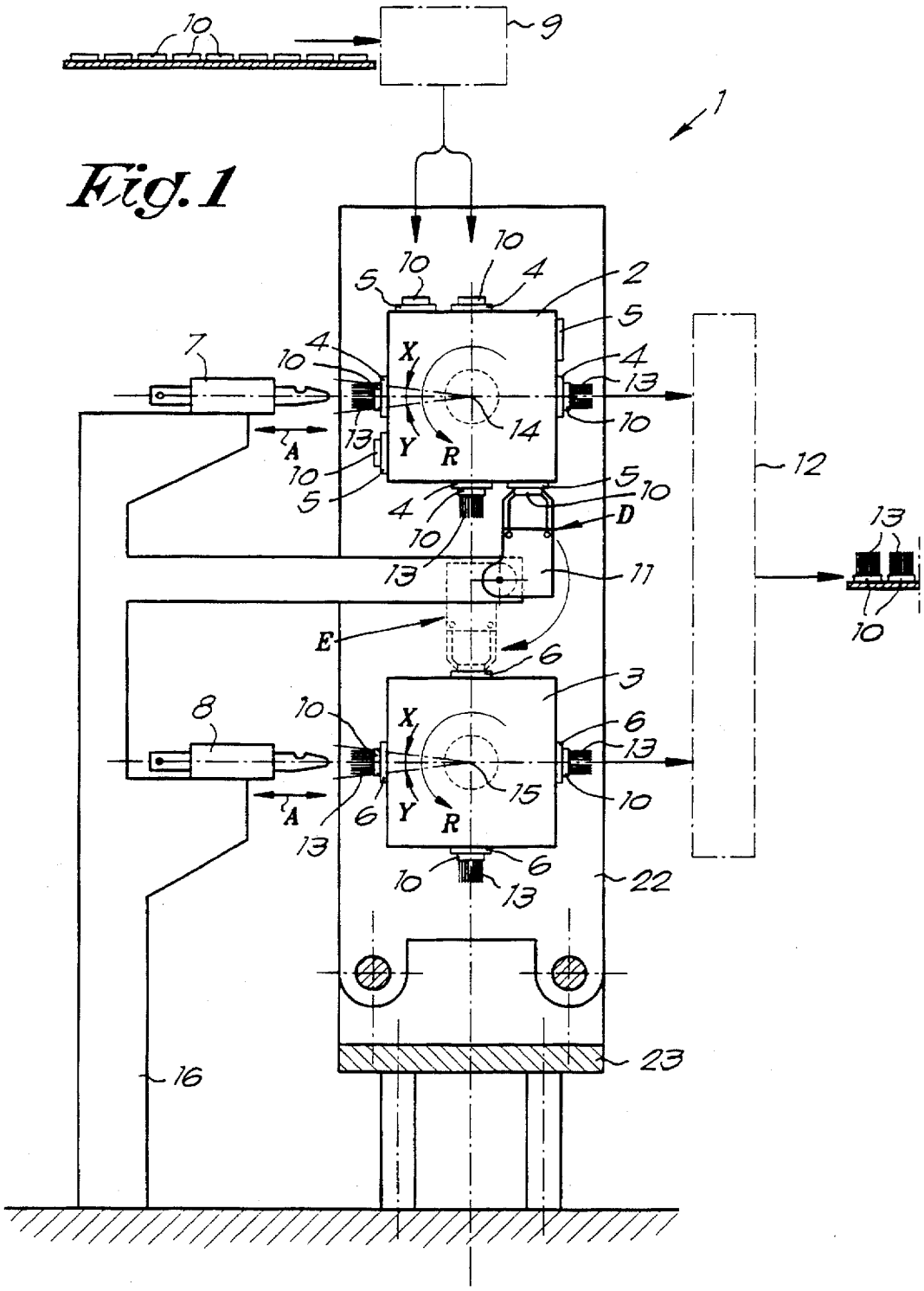
FIG. 1 is a schematic representation of a brush manufacturing machine according to the invention.
Figure 2:
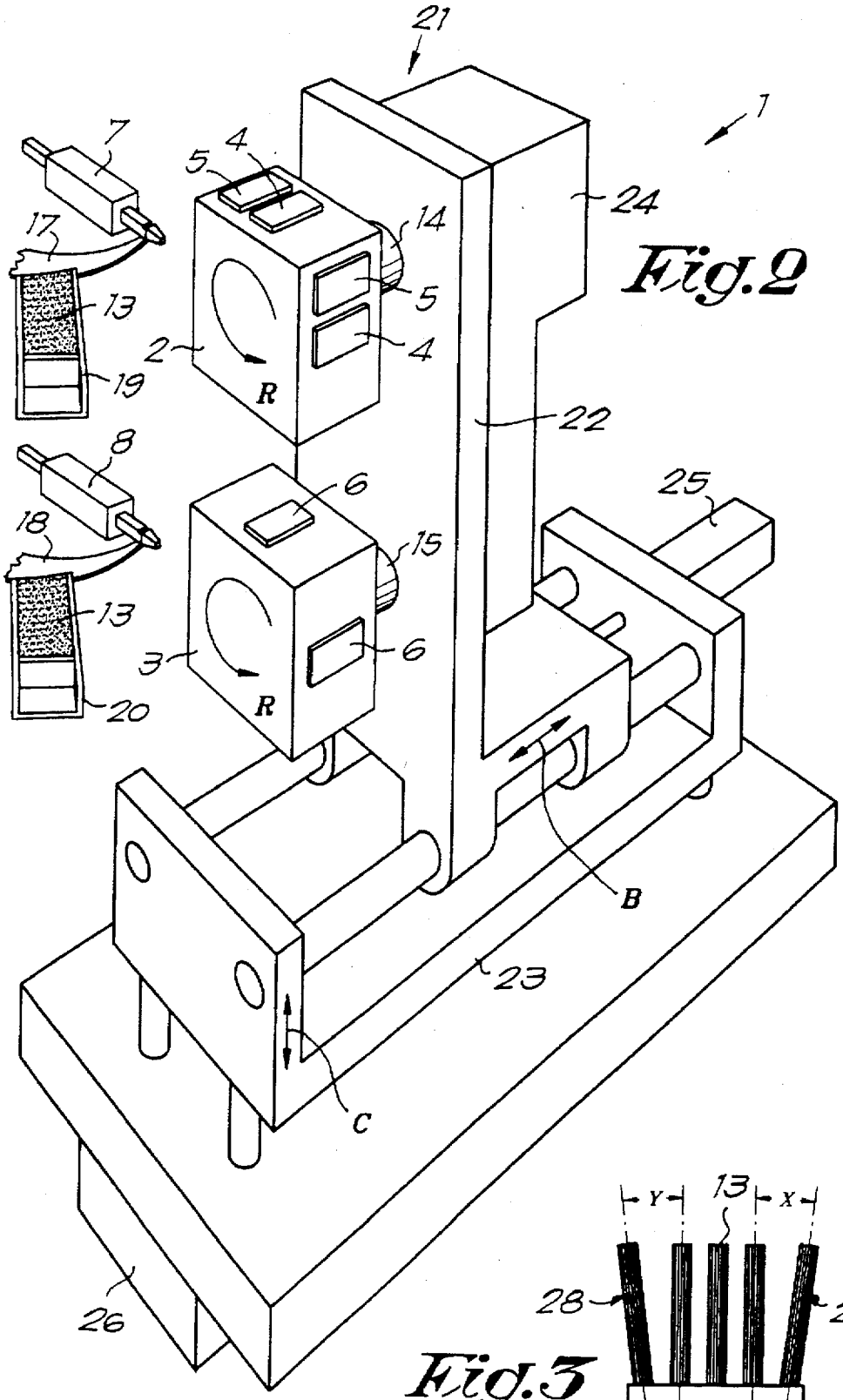
FIG. 2 schematically represents the brush manufacturing machine of FIG. 1 in perspective, whereby a number of parts of FIG. 1 are omitted for clarity's sake.

As represented in FIGS. 1 and 2, the brush manufacturing machine 1 according to the invention mainly consists of two preferably multi-sided rotatable drums 2–3 whose working side area are provided with several brush body holders, 4 to 6 respectively; a filling tool, 7 and 8 respectively, per drum 2–3; brush body supply means 9 which directly feed the unfilled brush bodies 10 to be filled to at least one of the above-mentioned drums, in this case the drum 2; at least one manipulator 11 provided between the drums 2 and 3 which makes it possible to carry over unfilled brush bodies 10 from one drum to another one, in this case from the drum 2 to the drum 3; and transport means 12 to carry the brush bodies 10 filled with brush fibres 13 away from the drums 2–3, whereby they can first be placed in a finishing machine as usual, for further processing such as warping, rounding off of brush ends, marking, etc.

As far as the configuration of these parts is concerned, the drums 2 and 3 are located vertically one above the other at successive workstations of the machine can preferably rotate around the axes of parallel horizontal rotary shafts 14 and 15, situated on top of one another, as represented in FIGS. 1 and 2, which is advantageous as far as drive and construction possibilities are concerned; the above-mentioned brush supply means 9 are preferably erected on top of the topmost drum at the first workstation 2; the filling tools 7–8 are preferably erected all along the same side, next to the drums 2–3, so that they can be provided with a common drive; the manipulator 11 is preferably provided underneath the drum 2 from where it has to remove brush bodies 10 and above the drum 3 upon which the removed brush bodies 10 must be provided, so that the distance to be spanned is minimal; and the transport means 12 are preferably provided on the side opposite of the drums the filling tools 7–8.

The supply means 9, which make sure that the brush bodies 10 to be filled are automatically placed in the brush body holders 4 and 5 on a side of the first drum 2, can have any known configuration whatsoever and consequently are not described in detail here. The same goes for the transport means 12.

The brush body holders 4, 5 and 6, consist of known clamping devices in which the brush bodies 10 can be clamped, and represented schematically for clarity's sake. On each working side area of the preferably square drum 2 there is provided a group of two brush body holders 4 and 5, whereas each side area of the drum 3 only carries one brush body holder 6. It should be noted hereby that the drums 2 and 3 do not necessarily need to be square with four side areas with brush body holders. It is clear that also drums with more than four side areas, or less, can be used.

The filling tools 7–8 are preferably mounted fixed on a frame 16 and can only carry out a filling movement A. These filling tools 7–8 are preferably moved simultaneously. As is generally known, the filling tools are hereby fed with bundles of fibres by means of bundle removers, 17 and 18 respectively, which each cooperate with a fibre cartridge, 19 and 20 respectively. These bundle removers 17–18 and fibre cartridges 19–20 are only represented in FIG. 2 for clarity's sake.

The above-mentioned drums 2–3 can not only carry out a rotary movement R, they can also be moved by means of a mechanism 21 which provides for the positioning of the brush bodies 10 for the filling tools 7 and 8.

The drums 2 and 3 are moved simultaneously. In the example shown, they are provided to this end on a carriage 22 which can be moved according to a direction B, parallel to the rotary shafts 14 and 15, and which is mounted in turn on a carriage 23 which can be moved vertically according to arrow C. Drive means 24, 25 and 26, which are suitably controlled by means of a control unit which is not represented, provide for the rotation of the drums 2 and 3 and the movements of the carriages 22 and 23 respectively.

The above-mentioned manipulator 11, which is solely represented in FIG. 1 for clarity's sake, consists for example of a controlled clamp, which can at least rotate between a first position D in which it can remove a brush body 10 from the drum 2 at one workstation and a second position E in which it can place the above-mentioned brush body 10 on the other drum 3 at a following workstation. According to FIG. 1, the manipulator 11 is mounted rotatable on the frame 16, but according to a variant it can also be mounted on the carriage 22.

The whole is designed such that certain brush body holders of the drum 2, in this case the brush body holders 4, each time cooperate with the accompanying filling tool 7, whereas the other brush body holders of this drum 2, in this case the brush body holders 5, exclusively cooperate with the above-mentioned manipulator 11 and consequently only have a pass-on function.

The transport means 12 can be of any nature whatsoever. They may consist of one or several manipulators which place the manufactured brushes in a finishing device, for example for the warping and rounding off of the fibres.

The working of the brush manufacturing machine 1 and the method applied hereby is as follows.

In a first stage, the supply means 9 make sure that both brush body holders 4 and 5 turned towards them on the first drum 2 are provided with an unfilled brush body 10 to be filled.

Then, the drums 2 and 3 are rotated one step further, which in this case implies a quarter turn to the left, so that the brush body 10 placed in the brush body holder 4 during the above-mentioned stage, ends up before and is presented to the filling tool 7 and is subsequently filled with brush fibres 13.

In a following stage, the unfilled brush body 10 which is situated in the brush body holder 5 is presented to the manipulator 11, which takes this brush body 10 out of the brush body holder 5 and carries it to the drum 3 at the next filling workstation, where it is placed in the brush body holder 6 turned towards the manipulator 11.

After the drums 2 and 3 have rotated another step further, the brush body 10 which was moved by the manipulator 11 ends up before the filling tool 8 and it is subsequently filled with brush fibers 13. The brush body 10 which was originally filled at the filling tool 7 is then carried off by the transport means 12.

After the drums 2 and 3 have rotated another two steps further, the above-mentioned brush body 10 which was filled by the filling tool 8 can also be carried off by the transport means 12.

It is clear that after each rotation of the drum 2, new brush bodies 10 are supplied to the drum at the first filling workstation, so that there is a continuous process.

Figure 3:
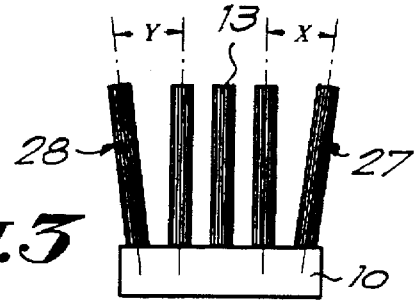
FIG. 3 represents a brush which was manufactured with the brush manufacturing machine of FIGS. 1 and 2.

The drums 2 and 3, the brush body holders 4–5–6 provided on it and the filling tools 7 and 8 are preferably mutually arranged such that each filling tool, 7 and 8 respectively, is situated centrally before its respective drum, 2 and 3 respectively. This means that the brush body holders 4 and 6 are necessarily situated in the middle of the side upon which they are provided, whereas the other brush body holders which only have a pass-on function, in this case the brush body holders 5, can be situated off-centre. This arrangement makes it possible to symmetrically insert fibre bundles 27 and 28 at an angle, by means of small angular displacements X and Y, as represented in FIG. 3, which is among others useful for the manufacturing of certain types of tooth brushes.

Depending of the size of the angular displacements X and Y, it can be useful to correct the rotated position of the drums concerned in the height and depth, for example by moving the drums, that the filling tools are positioned at the right places in front of the brush bodies 10 as the fibre bundles 27 and 28 are provided, and to moreover obtain that these fibre bundles are inserted just as deep as the other fibre bundles.

Figure 4:
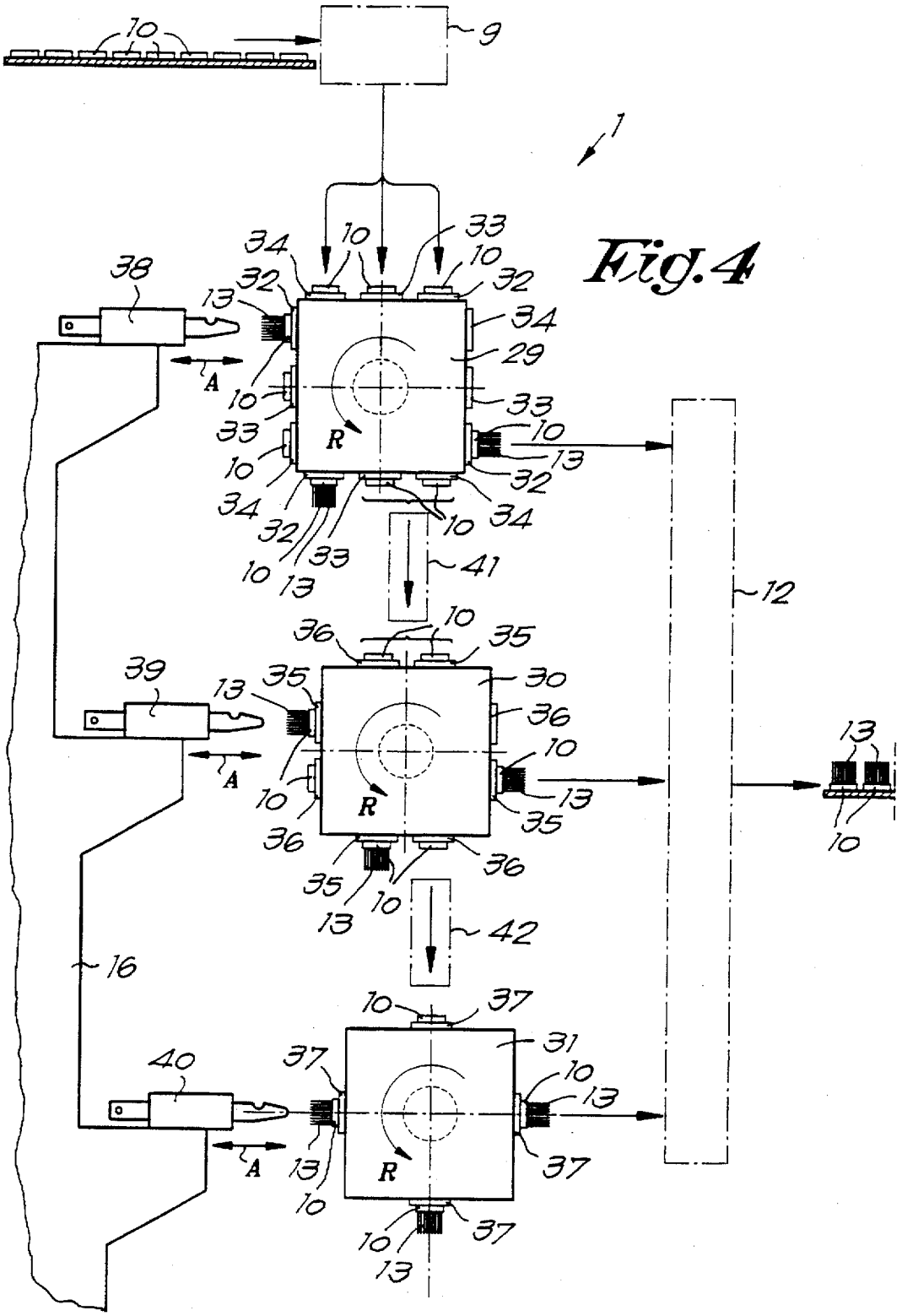
FIGS. 4 and 5 schematically represent two embodiments of the invention.

The invention is not limited to the use of two drums 2 and 3. By means of example, FIG. 4 represents an embodiment with three drums 29–30–31 at three workstations, of which the first is provided on each side with three brush body holders 32–33–34, the second with two, 35 and 36 respectively, and the third with one, namely 37. Further, use is made of three filling tools 38–39–40 and two manipulators 41–42. The first manipulator 41 each time removes two brush bodies 10, whereas the second manipulator 42 each time removes one brush body 10.

Moreover, the arrangement and working is analogous to those of the embodiment in FIGS. 1 and 2.

In a more general manner, one can say that if the number of drums is Z in a series including an $N^{th}$ drum following the 1st drum of the series, the arrangement is preferably such that the N-th drum is provided on each side with at least Z-N+1 brush body holders; that the brush supply means cooperates with the first drum only in the series and to this end provides for the supply of unfilled brush bodies to all brush body holders; and that between each N-th and N+1st drum is provided a manipulator which removes Z-N brush bodies per machine cycle (each machine operation including those machine events including and following each unfilled brush body supply event at the first workstation up to the next brush body supply event at the first workstation).

Figure 5:
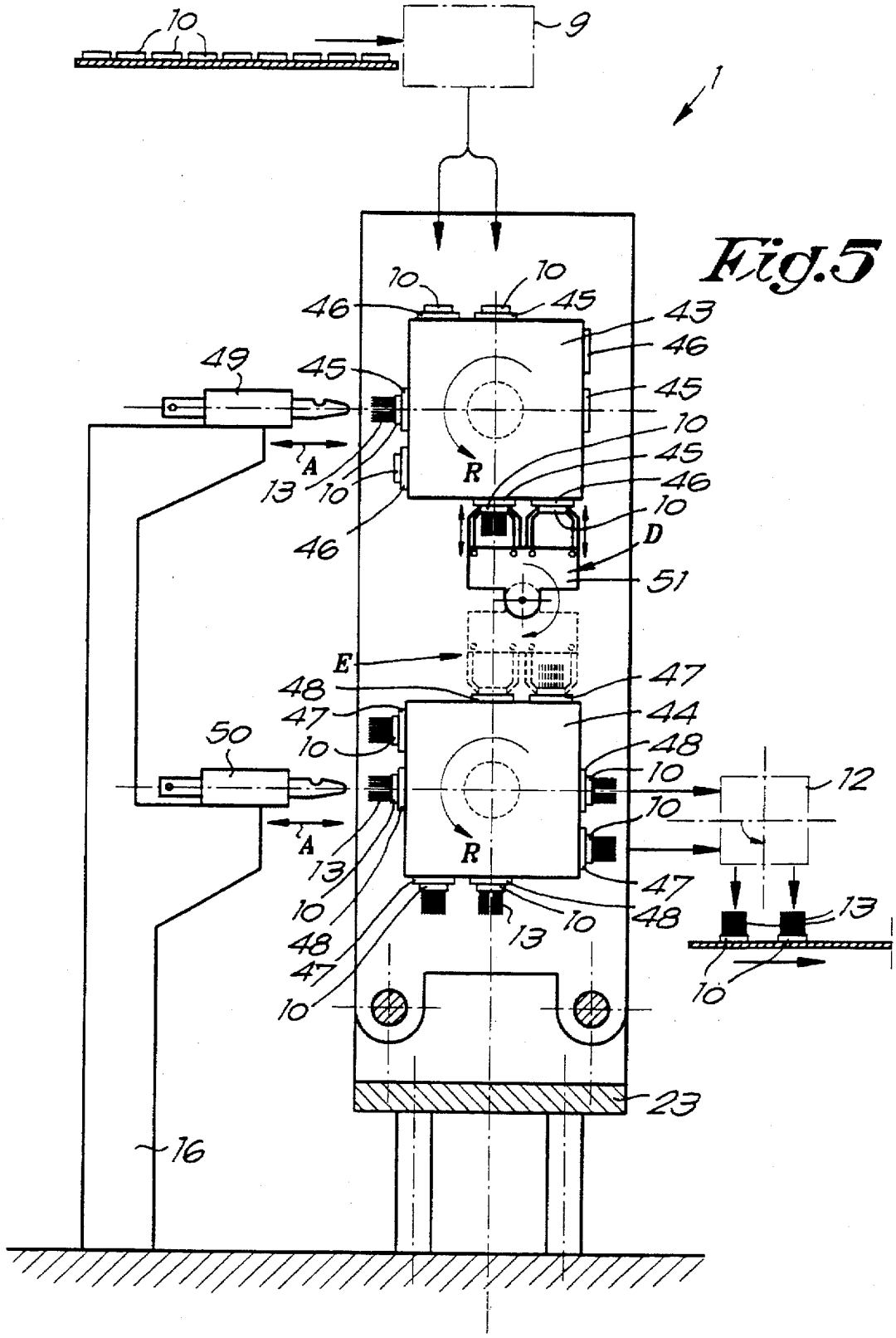

FIG. 5 shows another variant of the invention, with two drums 43–44 upon which are provided two brush body holders, 45–46 and 47–48 respectively, on each side, with two filling tools 49–50 and one manipulator 51. This variation is distinguished in that the whole is designed such that all filled brush bodies 10 finally end up on one drum, in this case the drum 44, whereby the above-mentioned transport means 12 exclusively cooperates with this drum 44.

The manipulator 51 in this case moves both filled and empty brush bodies 10 from one drum to the other. As represented, use can be made to this end of a double manipulator 51 containing two clamps, which cooperate with the brush body holders 45–46 and 47–48 respectively.

As the manufactured brushes hereby have to be removed from only one drum 44, the transport, and possibly the insertion in a finishing machine is simplified.

Naturally, the special characteristics of the embodiment of FIG. 5 can also be applied to embodiments with more than two drums 43–44. In a more general way, one can hereby say that if the number of drums in a series in the machine is Z, the arrangement is preferably such that each drum is provided on each side with at least Z brush body holders; that the brush supply means 9 cooperates with only one drum, preferably the first one, and to this end provides for the supply of brush bodies 10 to all brush body holders; that between each two subsequent drums in the series is provided a manipulator which removes Z brush bodies 10 per machine cycle and that the transport means 12 cooperates with only one drum of the series, preferably the last one.

It should be noted that the filled brush bodies 10 on the last or bottommost drum 3, 31 or 44 can also be carried off from underneath instead of along the side of the respective drum concerned. It is clear that this is particularly advantageous in the embodiment of FIG. 5.

The present invention is by no means restricted to the embodiments described as an example and represented in the accompanying drawings; on the contrary, such a brush manufacturing machine and method for manufacturing brushes can be realized according to several variants while still remaining within the scope of the invention.

What is claimed is:

1. In a brush making machine wherein at least one rotary brush body carrying drum located at a filling workstation is cyclically supplied with empty brush bodies by a brush body feeding device and is cyclically rotated to cause said brush bodies to eventually be presented in proper position before a filling tool for filling of the brush bodies with brush fibers, the improvement comprising:

said machine including a series of at least two drums located at sequential filling workstations;

at least one filling tool located at each workstation for cooperating with one respective drum of said series and for delivering brush fibers to pre-selected brush bodies carried by the one respective drum; and at least one brush body manipulator operable so as to periodically engage and transfer at least one brush body from at least one of said drums located at one workstation to at least another one of said drums located at another following workstation.

2. The improvement in a brush making machine as claimed in claim 1, including a brush body feeding device arranged to feed empty brush bodies directly to one of the drums of the series.

3. The improvement in a brush making machine as claimed in claim 1, wherein only a single brush filling tool is provided at each sequential filling workstation.

4. The improvement in a brush making machine as claimed in claim 3, wherein each drum of the series includes multiple working side areas whereat a brush body holder or a group of brush body holders is provided for receiving a brush body or brush bodies during each machine cycle, and wherein each respective filling tool is disposed centrally opposite a side area of a respective drum of the series each machine cycle.

5. The improvement in a brush making machine as claimed in claim 1, wherein at least one of said drums includes brush body holding means devoted exclusively to holding and carrying brush bodies to be transferred by the manipulator to another drum.

6. The improvement in a brush making machine as claimed in claim 5, wherein each drum of the series includes multiple working side areas whereat a brush body holder or a group of brush body holders is provided for receiving a brush body or brush bodies during each machine cycle, and wherein each respective filling tool is disposed centrally opposite a side area of a respective drum of the series each machine cycle.

7. The improvement in a brush making machine as claimed in claim 1 including brush body transport means for carrying filled brush body away from at least one of the drums, wherein at least one of said drums includes brush body holding means devoted exclusively to holding and carrying of brush bodies to be carried away by the brush body transport means.

8. The improvement in a brush making machine as claimed in claim 1, wherein said at least one or each manipulator comprises a clamp device mounted for rotation adjacent the drums with which it or they cooperate(s), and wherein said at least one or each manipulator is rotatable between first and second positions; wherein at said first position each manipulator is located so as to engage and remove at least one brush body from the drum at said one workstation and at said second position is located so as to place the removed brush body or bodies on said another drum at said another following workstation.

9. The improvement in a brush body making machine as claimed in claim 1, wherein said or each manipulator(s) is (are) located between the respective drums with which it or they cooperate(s).

10. The improvement in a brush making machine as claimed in claim 1, wherein a drum at one filling workstation in said brush making machine includes groups of brush holders disposed adjacent each other, and wherein at least one of the brush holders of each group is dedicated exclusively to carrying and presenting an unfilled brush body to a manipulator.

11. The improvement in a brush making machine as claimed in claim 10, wherein said series of drums includes Z drums including an $N^{th}$ drum located after the first drum of the series, each drum including multiple working side areas whereat a brush body holder or a group of brush body holders is provided for supporting a brush body or brush bodies during an operation of the machine each machine cycle; each side area of the $N^{th}$ one of said drums being provided with Z-N+1 brush body holders; wherein a single brush body supply device is arranged to feed empty brush bodies to the brush making machine via the first drum of the series; and wherein said manipulator is located between each $N^{th}$ and N+1 drum, said manipulator arranged to remove Z-N brush bodies per machine cycle.

12. The improvement in a brush making machine as claimed in claim 1, wherein the or all the manipulator(s) is (are) arranged such that all the brush bodies filled by the filling tools are ultimately located on the last drum of the series and wherein said brush body transport means is arranged to cooperate exclusively with said last drum.

13. The improvement in a brush making machine as claimed in claim 12, wherein said series includes Z drums at successive filling workstations, each drum including multiple working side area whereat a brush body holder or a group of brush body holders is provided for supporting a brush body or brush bodies during an operation of the machine each machine cycled, each side area having Z brush body holders; a brush body feeding device constituting the sole source of empty brush bodies for the machine and being arranged to feed empty brush bodies to the drum of the first workstation in the series; and each manipulator being disposed between successive drums of the series; each manipulator arranged to transfer Z brush bodies between said successive drums per machine cycle.

14. The improvement in a brush making machine as claimed in claim 1, wherein said drums are located vertically above one other and are rotatable about parallel generally horizontal axes of rotation.

15. The improvement in a brush making machine as claimed in claim 14, including a brush body feeding device located above the uppermost drum of the series; each filling tool is located on the same side of the drums of the series; each manipulator is located beneath the one drum from which it engages and removes a brush body and above the other drum to which each brush body engaged by the manipulator is transferred; and wherein said transport means is located on the side of the drum of the series with which it cooperates that is opposite the side on which the respective filling tool for such drum is located.

16. The improvement in a brush making machine as claimed in claim 1, including means for rotating said at least two drums simultaneously for causing brush bodies carried by the at least two drums to be presented simultaneously to respective filling tools.

* * * * *